US005495150A

United States Patent [19]

Zawislak et al.

[11] Patent Number: 5,495,150

[45] Date of Patent: Feb. 27, 1996

[54] SEQUENTIAL, DIFFERENTIAL IGNITION OF SERIES OPERATED ARC LAMPS

[75] Inventors: Robert M. Zawislak, Palatine; Donald A. Brichta, Western Springs; Donald V. Comiskey, West Chicago, all of Ill.

[73] Assignee: Northrop Grumman Corporation, Los Angeles, Calif.

[21] Appl. No.: 398,242

[22] Filed: Mar. 3, 1995

[51] Int. Cl.[6] ..... G05F 1/00

[52] U.S. Cl. ..... 315/294; 315/301; 315/192; 315/209 CD; 315/289

[58] Field of Search ..... 315/294, 189, 315/192, 301, 306, 241 S, 241 P, 209 CD, 299, 301, 289

[56] References Cited

U.S. PATENT DOCUMENTS

| | | | |
|---|---|---|---|
| 4,461,982 | 7/1984 | Fähnrich | 315/290 |
| 4,958,109 | 9/1990 | Naum | 315/307 |
| 5,013,977 | 5/1991 | Droho | 315/289 |

*Primary Examiner*—Robert J. Pascal
*Assistant Examiner*—Reginald A. Ratliff
*Attorney, Agent, or Firm*—Terry J. Anderson; Karl J. Hoch, Jr.

[57] ABSTRACT

A series of arc lamps each has an inductor connected in series with its anode which is field-coupled to a similar inductor connected to its cathode, the inductors being connected in series with each other through the inductors between an arc lamp power supply and a high current modulator for illuminating the arc lamps, once ignited. Ignition takes place serially from a single source of high voltage through respective charging networks, the charge time of each network being different from the others so as to successively create arcs in the arc lamps in sequence. The high voltage used for initial ignition of the arc lamps is differentially balanced to ground by means of the coils in series with the cathode and anode respectively of each arc lamp. The coils are poled so that the buildup of field in each coupled pair oppose each other, thereby rendering the coils invisible to the high current modulation during illumination of the arc lamps.

13 Claims, 1 Drawing Sheet

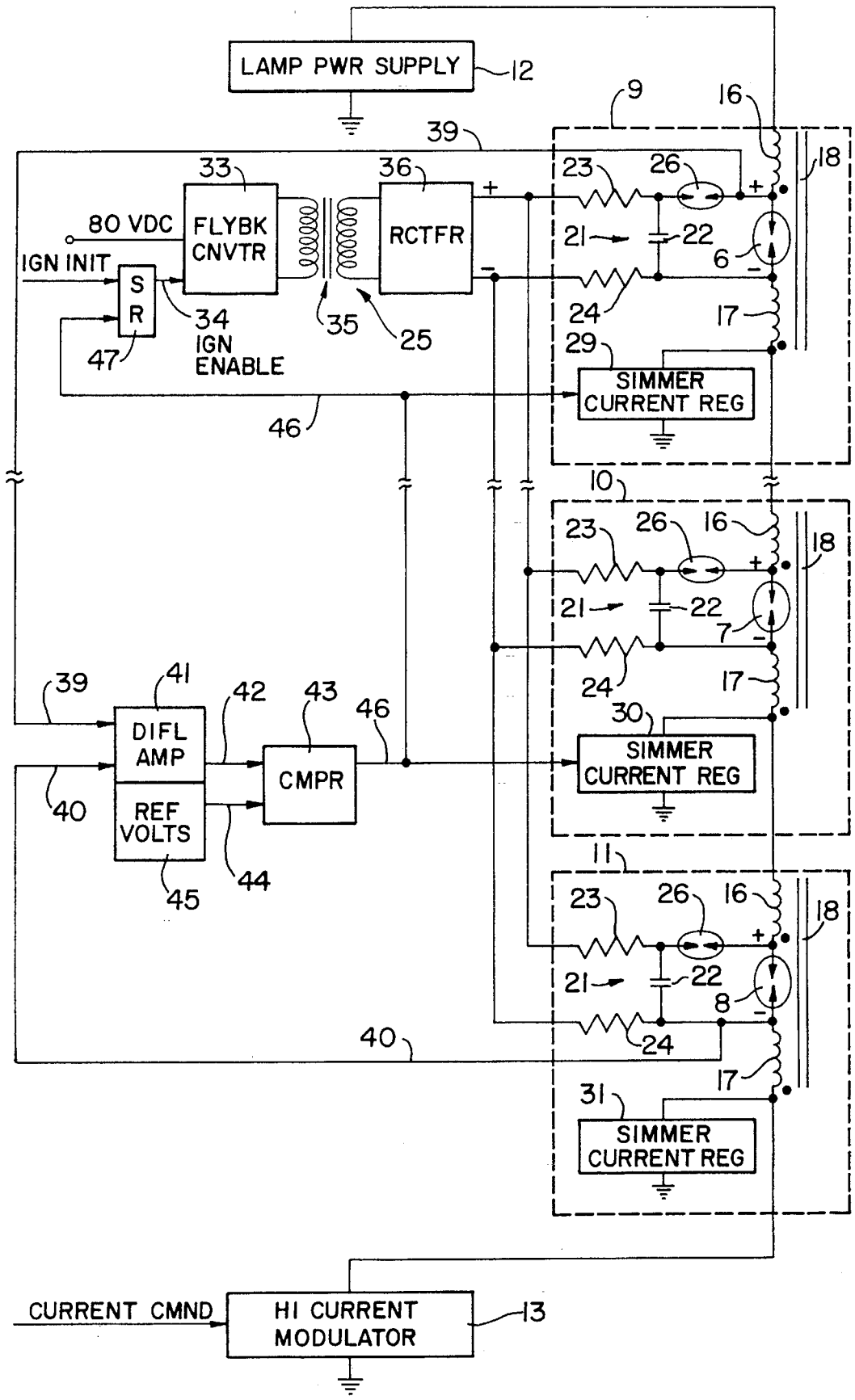
LAMP PWR SUPPLY
12
9
16
39
33
36
18
23
26
80 VDC
FLYBK CNVTR
RCTFR
21
22
IGN INIT
S
R
6
24
17
34
IGN ENABLE
35
25
29
47
SIMMER CURRENT REG
46
10
23
26
16
18
21
22
7
24
17
39
41
42
43
46
30
DIFL AMP
CMPR
SIMMER CURRENT REG
40
REF VOLTS
44
45
11
23
26
16
18
21
22
8
24
40
17
31
SIMMER CURRENT REG
CURRENT CMND
HI CURRENT MODULATOR
13

SEQUENTIAL, DIFFERENTIAL IGNITION OF SERIES OPERATED ARC LAMPS

TECHNICAL FIELD

This invention relates to igniting a plurality of arc lamps which are connected in series, and to igniting them sequentially, one lamp at a time, with reduced voltage and apparatus requirements.

BACKGROUND ART

For some specific applications, it is desirable to operate arc lamps, having a short arc space, in series because the voltage drop of such lamps is relatively low, (15–18 volts), and individual lamp operation (that is, with the lamps connected in parallel) results in inefficient high current power transfer from the associated power processing circuitry. By operating arc lamps in series, a higher effective voltage is presented to the power conditioning circuitry, and improved system power transfer efficiency is thereby achieved. Improved efficiency is especially important because the arc lamps may be modulated at peak currents as high as 400 amps and with duty cycles in excess of 50%.

On the other hand, ignition of series connected arc lamps usually requires a voltage on the order of: the voltage required to ignite an individual arc lamp, multiplied by the number of arc lamps in the series. The ignition voltage for typical arc lamps is on the order of 11,000 volts. Thus, a string of arc lamps could require 22,000 volts, 33,000 volts, and upwards, depending on how many lamps are in the series string. One use for multiple arc lamp sets is in jamming infrared tracking systems on aircraft. In high altitude airborne environments, the voltage standoff spacing required for this level of ignition voltage (in excess of 22,000 volts) is prohibitive.

DISCLOSURE OF INVENTION

Objects of the invention include provision of series connected arc lamps which are easily ignited, using relatively low voltage, with a minimum of required equipment.

According to the present invention, a plurality of series connected arc lamps are ignited from a single high voltage power supply by means of discharging a charged capacitor through a spark gap, and after the arcs thereof are stabilized, they are modulated (ionized) with very high currents in series to cause illumination. In accordance further with the invention, as each arc lamp is ignited, a low, regulated current is sustained in the arc lamp, awaiting the high current ionization (illumination) of the arc lamp in use by means of a high current modulator, which provides pulsed ionization to the whole series of arc lamps, together. In accordance further with the invention, the arc lamps in a series-modulated set of arc lamps are ignited sequentially, because the RC time constant of the charge network related to successive arc lamps are successively higher, thereby giving each charge network time to reach the full ignition voltage and ignite the corresponding lamp before the next charge network in the series reaches the full ignition voltage. According to the invention further, each arc lamp is maintained in the ignited condition by a simmer current regulator while the other arc lamps are being ignited; when the last arc lamp is ignited, and its arc is being maintained by a simmer current regulator, the simmer current regulators for the remaining arc lamps may all be off; the minimal arc current in all of the arc lamps is then maintained in series under control of a single simmer current regulator. Each arc lamp may have its own simmer current regulator, or a pair of current regulators may be switched among the arc lamps.

In accordance with the invention further, the high voltage used to ignite the arc lamps is applied differentially (balanced to ground), thereby reducing by half the voltage to ground which must be accommodated by standoff spacing and other insulation considerations. According to this invention further, the balancing is achieved by means of coupled inductors connected in series with the arc lamps, one to the cathode and one to the anode, the fields of which aid each other during ignition so as to provide balancing the voltage to ground, but which saturate at simmer current levels, and thereby are invisible to the high current modulation used to illuminate the lamps.

The invention allows igniting series connected arc lamps utilizing only the voltage required for a single arc lamp, and requiring the accommodation of only half that voltage with respect to ground.

Other objects, features and advantages of the present invention will become more apparent in the light of the following detailed description of exemplary embodiments thereof, as illustrated in the accompanying drawing.

BRIEF DESCRIPTION OF THE DRAWINGS

The sole FIGURE herein is a simplified schematic block diagram of sequential, differential arc lamp ignition in accordance with the present invention.

BEST MODE FOR CARRYING OUT THE INVENTION

Referring to the drawing, a plurality of arc lamps 6–8 are each associated with corresponding ignition circuitry 9–11 which connect the arc lamps in series between a lamp power supply 12 and a high current modulator 13. Each of the circuits 9–11 is identical to the others, except in one respect described hereinafter.

Between the power supply 12 and the current modulator 13, each arc lamp 6–8 is connected with an inductor 16 at its anode (+) and an inductor 17 at its cathode (–). The fields of the inductors related to each arc lamp are coupled together, such as by means of a core 18. A charge network 21 is connected across each of the arc lamps 6–8. Each charge network includes a charge capacitor 22 connected through a pair of high-resistance resistors 23, 24 across the output of a high DC voltage ignition power supply 25. During the ignition process, the ignition power supply 25 will provide on the order of 11,000 volts across the charge network 21; when the capacitor reaches a charge of nearly that amount, a spark gap 26 in each of the charge networks allows the related capacitor 22 to discharge through the associated arc lamp 6–8. To cause sequential ignition, even though all of the circuits 9–11 are connected to the ignition power supply 25 at the same time, the RC time constants of the networks 9–11 are all different. Once each of the arc lamps 6–8 ignites, a minimal arc current is maintained therein by a corresponding simmer current regulator 29–31. The difference in the charge time for the successive circuits 9–11 may be on the order of a half second, while the overall charge time for the fastest one of them may be on the order of one second. The first, second (and so forth) may recharge, but once simmer current is established, further ignition pulses are of no consequence.

Differential operation, that is, with the voltage of the anode to ground and the voltage of the cathode to ground both being maintained at half of the cathode-anode voltage during ignition, is accomplished by means of the coils 16, 17 which are poled (as shown by the dot notation in the drawing) so that with the anode positive and the cathode negative, coupled fields of the coils support each other, as very small currents pass through the coils to AC ground. During actual ignition caused by discharge of the capacitor 22, the current through the corresponding arc lamp 6–8 does not pass through the coils 16, 17; but because the lamp power supply (having a very large capacitor storage bank) and the simmer current regulator 29 (being totally saturated as it regulates essentially no current) both represent AC ground, the peak voltage developed across the arc lamps 6–8 will be balanced to ground in each case.

The ignition power supply 25 may be formed by means of a flyback converter 33 which may be powered, for instance, by 80 volts DC. When enabled, by an ignition enable signal on a line 34, the flyback converter 33 applies AC current to the primary of a step-up transformer 35, the secondary of which provides very high AC voltage to a rectifier 36, which produces the eleven kilovolt ignition voltage in this example.

The fact of all of the series connected arc lamps 6–8 having been ignited is determined by sensing a suitably low voltage across the entire series string of arc lamps. A line 39 connected to the anode of the first arc lamp 6 in the series and a line 40 connected to the cathode of the last arc lamp 8 in the series are applied to a differential amplifier 41, the output of which on the line 42 is the total voltage across the series of arc lamps. This voltage is applied to a comparator circuit 43 along with a reference voltage on a line 44 from a source of reference voltage 45. When the total voltage indicated on line 42 becomes less than the reference voltage on the line 44, the comparator 43 provides an output signal on the line 46 which is used to turn off the simmer current regulators 29, 30 of all of the arc lamps 6, 7 in the string, except for the simmer current regulator 31 related to the last arc lamp 8 of the string. The last simmer current regulator in the string 31 maintains simmer current in all of the series of arc lamps 6–8 throughout the following operation, both before, during and after high current modulation to cause illumination. The signal on the line 46 also is applied to a logic circuit represented herein by a simple bistable device 47 to remove the ignition enable signal and eliminate the high voltage output of the voltage multiplier 25.

A typical situation may include applying an ignition initiation signal to the set (S) side of the bistable 47 (or other equivalent logic circuitry) to thereby initiate the ignition process which has just been described. Then, there may be no further activity with respect to the arc lamps, for some time, such as throughout an entire airborne mission. However, whenever illumination of the arc lamps is required, following ignition thereof, then a current command signal is applied to the high current modulator 13. The high current modulator 13 is a bulk switching mode regulator configuration, operating at 300 to 400 amps, depending upon the voltage of the current command applied thereto. It is an available circuit, such a Unitrode UC1825 switching mode regulator integrated circuit, in which current builds up through an inductance, and when the current reaches a value proportional to the voltage command input, it shuts off and the choke backswings through a diode; when the current reduces to a determinable minimum amount, the process repeats. In this embodiment, the high current modulator may operate at a switching frequency of about 20 kilohertz or higher, with pulse capability on the order of 20%–25% duty cycle. The simmer current regulators 29–31 may also comprise suitable switching mode regulators, such as the aforementioned UC1825. The coils 16, 17 are saturated just below the simmer current level (which may be on the order of 2 or 3 amps).

The high current modulator 13 is disposed at the opposite end of the series connected arc lamps from the lamp power supply so that the lamp power supply can provide an AC ground to the anode of each arc lamp as it is being ignited.

Although use of the coupled inductors 16, 17, in order to differentially balance the high voltage to ground is preferred, in any case where the voltage to ground is of no significance, a single coil may be used on either side of each arc lamp to allow buildup of high pulse voltage between the lamp power supply and the simmer current regulators, both of which represent ground to the pulses.

Although it is preferred to fire the arc lamps sequentially, by means of different charge times in the charging networks, if a suitably large energy storage bank is provided at the output of the ignition power supply 25 (rectifier 36), the arc lamps could be ignited simultaneously. But they cannot be ignited randomly or in a bottom to top order, because all preceding arc lamps between a given arc lamp and the lamp power supply must have current flow for the arc in the given arc lamp to be maintained by the related simmer current regulator.

In this embodiment, the simmer current regulators 29, 30 are shut off at the same time. This is possible since all of the arcs will be established before any overheating can occur. If desired, additional voltage measurements (e.g., from the anode of arc lamp 6 to the cathode of arc lamp 7) could be taken, to turn off each simmer current regulator (e.g., 29) as soon as an arc is struck in the next arc lamp (e.g., 7) in the chain.

Instead of one simmer current regulator wired to each arc lamp, only a pair of simmer current regulators will suffice if one is switched from the first arc lamp to the third arc lamp, after the second arc lamp has fired, and one is switched from the second arc lamp to the fourth arc lamp after the third arc lamp has fired, and so forth. The firing of the second, third, etc. arc lamps is determined by measuring the voltage across two, three, etc arc lamps in the same fashion as shown for all arc lamps in the drawing.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A system for igniting and illuminating a plurality of arc lamps connected in series, comprising:

a plurality of arc lamps;

a coil corresponding to each of said arc lamps;

a DC voltage lamp power supply providing a voltage at its output suitable for driving a series connection of said lamps sufficiently for illumination thereof following ignition;

a high current modulator for controlling high current pulses through the series connected arc lamps, said arc lamps being connected in series with each other between said lamp power supply and said current modulator through their respective coils;

a high DC voltage ignition power supply providing at a pair of terminals a voltage suitable for initial ignition of one of said arc lamps;

a plurality of RC charge networks, one for each of said arc lamps, each having a capacitor, each plate of each capacitor connected through a resistor to a respective terminal of said ignition power supply, each capacitor connected through a spark gap across the corresponding one of said arc lamps, the RC time constant of each of said charge networks associated with each given arc lamp is higher than the RC time constant of all charge networks associated with arc lamps which are between said given arc lamp and said lamp power supply; and a plurality of simmer current regulators, each of said arc lamps associated with one of said simmer current regulators, each for regulating current from said lamp power supply through a corresponding one of said arc lamps until ignition of an arc lamp more remote in said series from said lamp power supply than said one arc lamp.

2. A system according to claim 1 wherein each of said simmer current regulators is connected in series with a corresponding one of said arc lamps across the output of said lamp power supply; and further comprising:

means responsive to the voltage across the series connection of said arc lamps for sensing a voltage below a threshold reference voltage and, in response thereto, turning off all of said simmer current regulators except the one corresponding to the one of said arc lamps farthest from said lamp power supply in said series.

3. A system for igniting and illuminating a plurality of arc lamps connected in series, comprising:

a plurality of arc lamps;

a coil corresponding to each of said arc lamps;

a DC voltage lamp power supply providing a voltage at its output suitable for driving a series connection of said lamps sufficiently for illumination thereof following ignition;

a high current modulator for controlling high current pulses through the series connected arc lamps, said arc lamps being connected in series with each other between said lamp power supply and said current modulator through their respective coils;

a high DC voltage ignition power supply providing at a pair of terminals a voltage suitable for initial ignition of one of said arc lamps;

a plurality of RC charge networks, one for each of said arc lamps, each having a capacitor, each plate of each capacitor connected through a resistor to a respective terminal of said ignition power supply, each capacitor connected through a spark gap across the corresponding one of said arc lamps; and a plurality of simmer current regulators, one for each of said arc lamps, each of said simmer current regulators connected in series with a corresponding one of said arc lamps across the output of said lamp power supply, each for regulating current from said lamp power supply through a corresponding one of said arc lamps until ignition of an arc lamp more remote in said series from said lamp power supply than said one arc lamp.

4. A system according to claim 3, wherein:

the RC time constant of each of said charge networks associated with each given arc lamp is higher than the RC time constant of all charge networks associated with arc lamps which are between said given arc lamp and said lamp power supply.

5. A system according to claim 3 further comprising:

means responsive to the voltage across the series connection of said arc lamps for sensing a voltage below a threshold reference voltage and, in response thereto, turning off all of said simmer current regulators except the one corresponding to the one of said arc lamps farthest from said lamp power supply in said series.

6. A system for igniting and illuminating a plurality of arc lamps connected in series, comprising:

a plurality of arc lamps;

a pair of coupled inductors corresponding to each of said arc lamps, one of said inductors being connected to the cathode of the related arc lamp and the other of said inductors being connected to the anode of the related arc lamp, said inductors being coupled through their fields in a manner that a field induced by a unidirectional current passing through one of said inductors and the related arc lamp is opposed and cancelled by a field induced by the same current through the other of said inductors;

a DC voltage power supply having a voltage suitable for driving a series connection of said lamps sufficiently for illumination thereof following ignition;

a high current modulator for controlling high current pulses through the series connected arc lamps, said arc lamps being connected in series with each other between said power supply and said current modulator through their respective coils;

a high DC voltage ignition power supply providing at a pair of terminals a voltage suitable for initial ignition of one of said arc lamps;

a plurality of RC charge networks, one for each of said arc lamps, each having a capacitor, each plate of each capacitor connected through a resistor to a respective terminal of said ignition power supply, each capacitor connected through a spark gap across the corresponding one of said arc lamps; and a plurality of simmer current regulators, one corresponding to each of said arc lamps, each connected in series with the corresponding one of said arc lamps across the output of said lamp power supply.

7. A system according to claim 6 additionally comprising:

means responsive to the voltage across the series connection of said arc lamps for sensing a voltage below a threshold reference voltage and, in response thereto, turning off all of said simmer current regulators except the one corresponding to the one of said arc lamps farthest from said lamp power supply in said series.

8. A system according to claim 6, wherein:

the RC time constant of each of said charge networks associated with each given arc lamp is higher than the RC time constant of all charge networks associated with arc lamps which are between said given arc lamp and said lamp power supply.

9. A method of igniting and illuminating a series of arc lamps, comprising:

connecting each of said arc lamps through a corresponding coil, in series with all other ones of said arc lamps and their corresponding coils, in a string between a lamp power supply, having a DC voltage suitable for driving the series connection of said arc lamps sufficiently for illumination thereof after ignition, and a high current modulator, for controlling high current pulses through said arc lamps to illuminate them;

discharging a high DC ignition voltage through a spark gap across each arc lamp separately to ignite an arc therein;

maintaining a low, arc sustaining simmer current in each arc lamp after ignition thereof; and thereafter, providing high current pulses through said arc lamps to cause them to illuminate.

10. A method according to claim 9 wherein said maintaining step comprises maintaining said arc sustaining current in each one of said arc lamps by means of a plurality of simmer current regulators, each of said arc lamps associated with one of said simmer current regulators, each for regulating current from said lamp power supply through a corresponding one of said arc lamps until ignition of an arc lamp more remote in said series from said lamp power supply than said one arc lamp.

11. A method according to claim 9 wherein said maintaining step comprises maintaining said arc sustaining current in each one of said arc lamps by means of a simmer current regulator associated uniquely with said one arc lamp until all of said arc lamps have an arc established therein.

12. A method according to claim 9 wherein said maintaining step comprises maintaining said arc sustaining current in all of said arc lamps, after all of said arc lamps have an arc established therein, by means of a single simmer current regulator connected to the end of said string opposite said lamp power supply.

13. A method according to claim 9 wherein said step of discharging comprises discharging said high DC ignition voltage through a spark gap across each one of said arc lamps in a sequence, beginning with the arc lamp closest in said string to said lamp power supply and ending with the arc lamp furthest in said string from said lamp power supply.

* * * * *